340-566 SR

XR 3,953,843

X 2042C
X 2045W
X 2096R

United States

Codina

[11] 3,953,843

[45] Apr. 27, 1976

[54] SWIMMING POOL ALARM

[75] Inventor: Jorge G. Codina, Hartsdale, N.Y.

[73] Assignee: General Scanning Devices, Inc., Greenwich, Conn.

[22] Filed: May 9, 1974

[21] Appl. No.: 468,237

[52] U.S. Cl. ..... 340/224; 325/116; 328/111; 340/167 A; 340/261

[51] Int. Cl.[2] ..... G08B 21/00

[58] Field of Search ..... 340/261, 224, 167 A, 340/164 B, 147 PC; 325/164, 322, 325, 116; 328/111, 178; 331/174

[56] References Cited

UNITED STATES PATENTS

| | | | |
|---|---|---|---|
| 3,366,881 | 1/1968 | Malone et al. | 325/322 |
| 3,636,544 | 1/1972 | Codina | 340/261 |
| 3,668,675 | 6/1972 | Joens et al. | 340/224 |
| 3,786,469 | 1/1974 | Massaro et al. | 340/261 |

*Primary Examiner*—Glen R. Swann, III
*Attorney, Agent, or Firm*—Bacon & Thomas

[57] ABSTRACT

An alarm system includes a floating transmitter which when activated by a wave will generate one short signal and then turn itself off. A radio receiver will detect and verify the time duration of the radio signal, and thereupon activate an audible alarm. The alarm will continue to sound until it is manually turned off.

11 Claims, 4 Drawing Figures

Fig. 1.
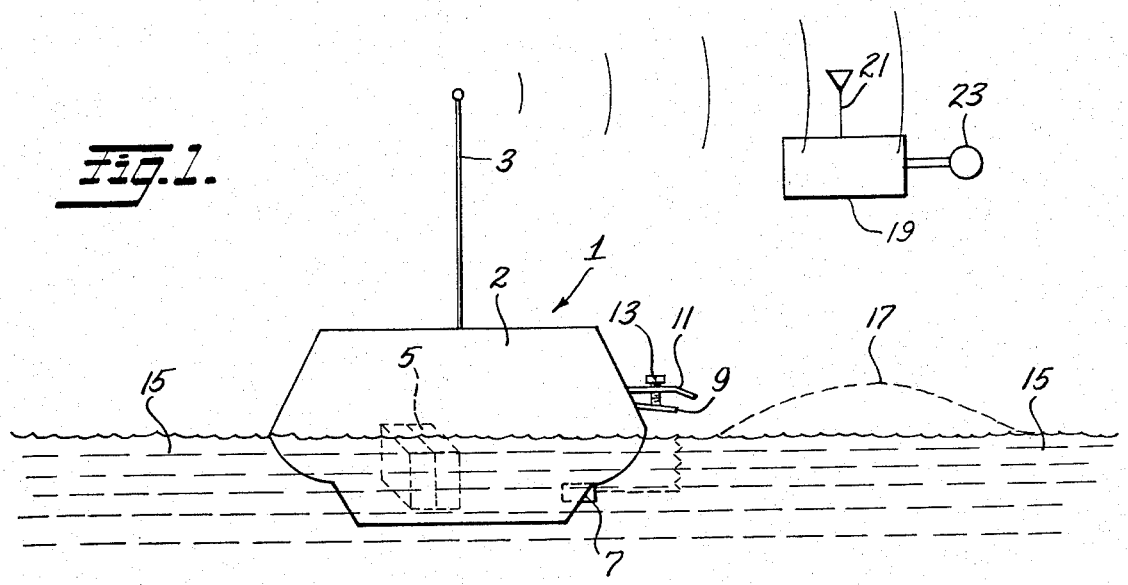
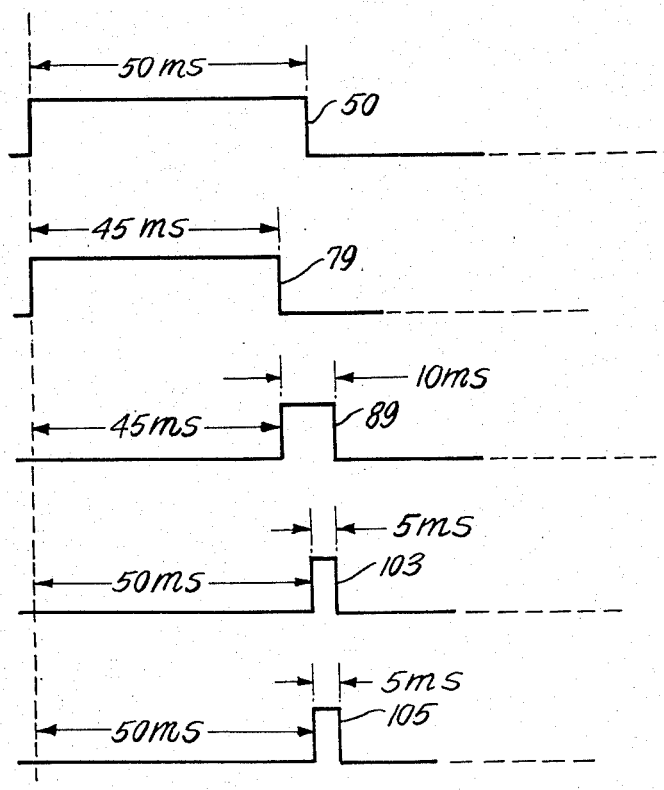
Fig. 4.

SWIMMING POOL ALARM

BACKGROUND OF THE INVENTION

The invention relates to a buoyant signaling device for transmitting an indication of the water condition. More specifically, the invention relates to a floating transmitter to be positioned in a swimming pool for detecting a splash, such as a child falling in the pool, and then transmitting a signal to a receiver which in turn energizes an alarm.

There have been a large number of devices developed and proposed for detecting when a splash occurs due, for example, to a small child falling into a swimming pool. One such example is my previous United States patent, Pat. No. 3,636,544. This application is an improvement over my previous patent which included a transmitter emitting a continuous signal to a receiver which energized an alarm. It has been found that in many instances the generation of a continuous signal is not desirable since it is conceivable that if not properly designed, interference could occur with surrounding electrical equipment.

OBJECTS AND SUMMARY OF THE INVENTION

It is an object of the instant invention to provide an alarm system of the type described above which will universally comply with laws and regulations governing radio transmission.

Specifically, it is an object of the invention to provide a radio transmitter and receiver arrangement whereby the transmitter is activated for only a very short period of time, thus generating a signal detected by a radio receiver and then shutting itself off. Thus, the transmitter sends out only a single burst, yet the receiver will initiate an alarm which will continue to sound until it is deenergized.

BRIEF DESCRIPTION OF THE DRAWINGS

The above and other objects and features of the invention will be more readily appreciated from the following description and appended claims wherein:

FIG. 1 is a view of the invention wherein the transmitter is positioned in a swimming pool;

FIG. 4 is a diagram of the time relationship of the signals generated in the radio receiver and decoding circuit.

DETAILED DESCRIPTION OF THE INVENTION

Figure 2:
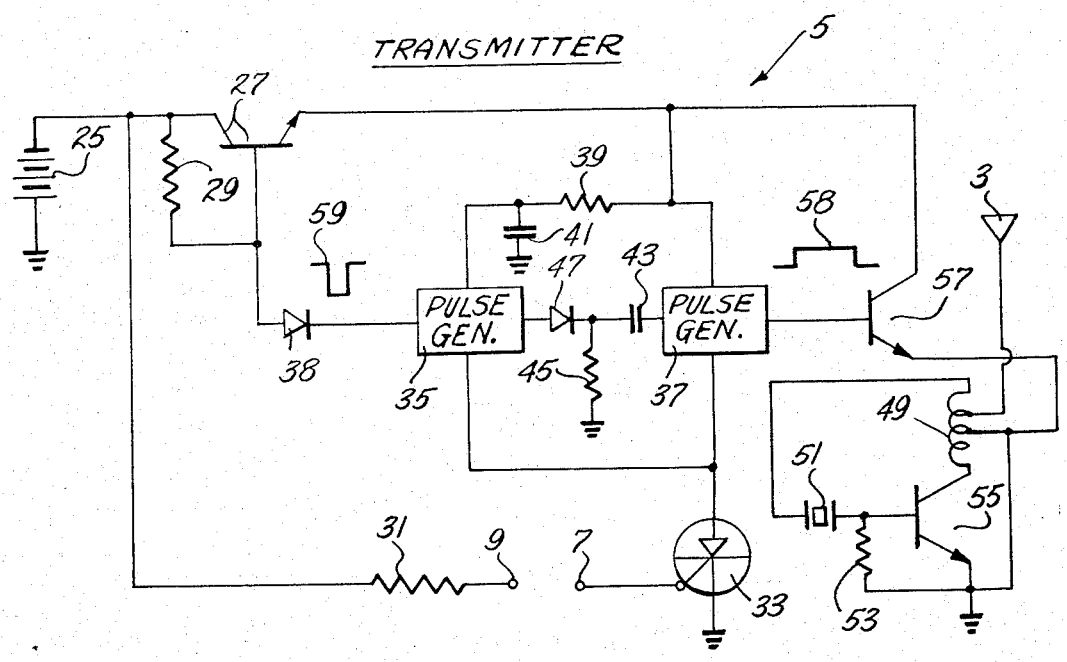
FIG. 2 is a schematic circuit diagram of the transmitter.

Referring to FIG. 1 a floating transmitter 1 is seen in a buoyant body 2 having an antenna 3 electrically connected to a battery powered transmitter 5 described below. An underwater contact 7 is positioned on the float, and a second contact 9 is normally positioned out of the water. A protective cover 11 is positioned over contact 9 to prevent rain from establishing a conducting path between contact 9 and the water. An adjusting screw 13 is positioned on the protective cover 11 and is adapted to cooperate with the contact 9, whereby adjustment of the screw 13 will permit movement of contact 9 closer or farther away from the water seen generally at 15. As will be discussed below, a wave is seen diagramatically illustrated by dotted lines 17. A receiver decoder unit 19 is positioned remote from the transmitter and may be mounted on a building or in a house. The receiver-decoder includes an antenna 21 and an audio signaling means 23 thereon.

TRANSMITTER

Referring now to the transmitter 5 in FIG. 2, a battery 25 is connected to ground and to the collector of transistor 27. A biasing resistor 29 is positioned in the collector-base circuit of transistor 27. The negative side of the battery is also connected through a current limiting resistor 31 to contact 9. Contact 7 is connected to the gate of an electronic switch in the form of an SCR 33. The cathode of SCR 33 is connected to ground and the anode is connected to a first integrated circuit monostable generator 35 and a second integrated circuit monostable generator 37.

The pulse generator 35 is coupled to the base of transistor 27 via a diode 38. As will be seen below a resistor 39 and a capacitor 41 are connected between the generators 35 and 37 for the purpose of storing energy for generator 35 for a given period of time. A high pass filter composed of a capacitor 43 and a resistor 45 is positioned between generators 35 and 37 through a diode 47. A radio transmitter consisting of a radio frequency coil 49, a crystal control 51, a biasing resistor 53 and a transistor amplifier 55 is connected to the emitter of a transistor 57. The collector of the transistor 57 is connected to the emitter of transistor 27 while the base is connected to generator 37. Antenna 3 is connected to coil 49 transmitting a signal 50 of about 50 milliseconds (see FIG. 4).

The operation of the transmitter is as follows: when a wave 17 of sufficient height occurs as seen in FIG. 1, contacts 7 and 9 will be bridged by the water. This will provide current to the gate of SCR 33 from battery 25, via current limiting resistor 31 and contacts 9 and 7. Once SCR 33 is gated on, pulse generator 37 will generate a pulse 58 of a prescribed duration. This pulse is fed through transistor 57 which activates the transmitter which is of conventional design. At the end of the pulse generated by pulse generator 37, a signal is sent to the other pulse generator 35. Before pulse generator 35 is activated, the signal is processed by the high pass filter composed of capacitor 43 and resistor 45. This signal which is negative in polarity will serve to trigger pulse generator 35. The pulse generator 35 in turn will generate a negative signal 59 which will be coupled through diode 38 to the base of transistor 27. Under such conditions transistor 27 will be cut off momentarily and this will in turn serve to cut off SCR 33. The function of resistor 39 and capacitor 41 as stated above is to store enough energy for generator 35 so that it can feed the cut off signal to the transistor 27 for a sufficient period of time.

RECEIVER-DECODER

Figure 3:
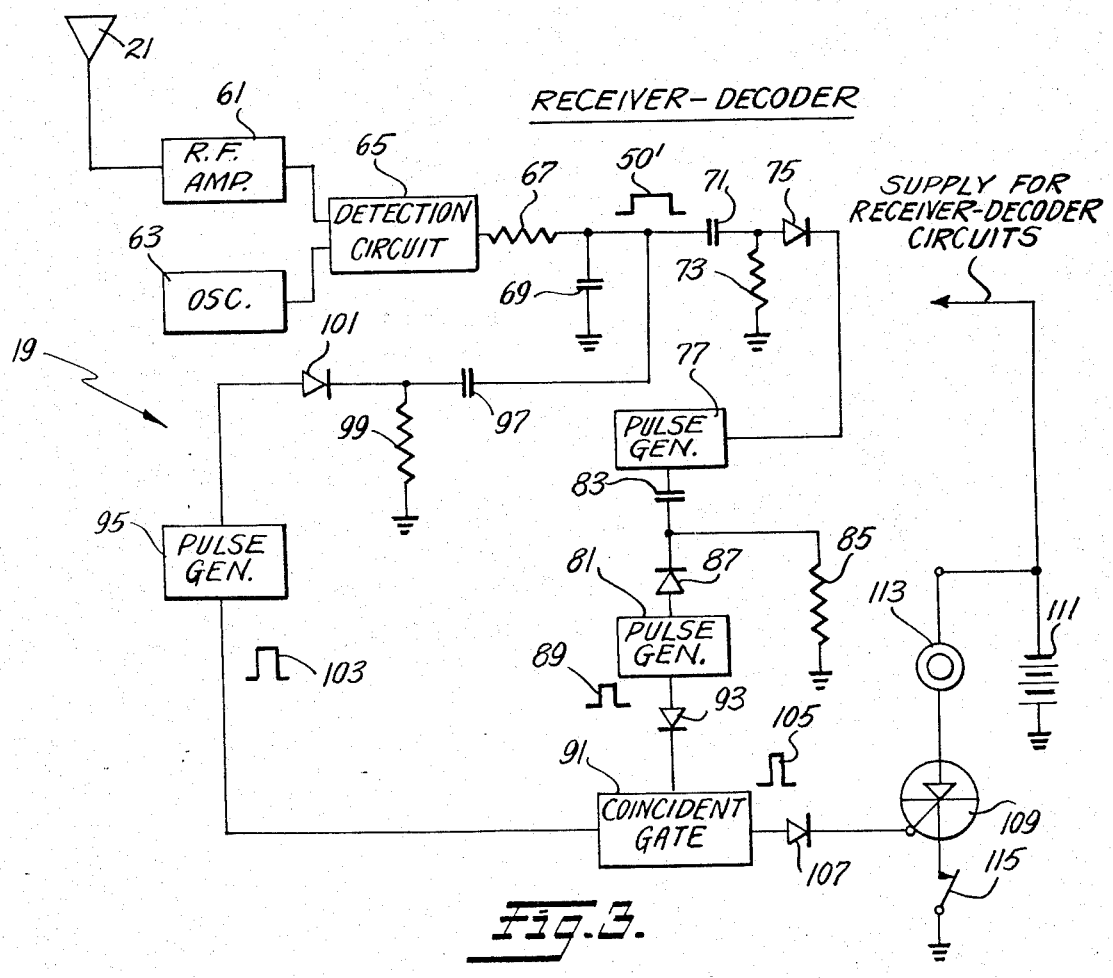
FIG. 3 is a schematic circuit diagram of the receiver and decoding circuit.

Referring now to the receiver and decoding circuit 19 in FIG. 3, a conventional radio frequency amplifier 61 is connected to the antenna 21. The amplified signal from amplifier 61 is fed simultaneously with a signal generated by a conventional oscillator 63 to a detection circuit 65. The detected signal is filtered by a resistor 67 and a capacitor 69, and this signal 50′(FIGS. 3 and 4) resembles the original transmitted pulse in shape and time. The leading edge of the pulse after being differentiated by a capacitor 71 and a resistor 73 is fed through a coupling diode 75 and triggers a pulse generator 77. The pulse generator 77 generates a delay signal 79 as seen in FIG. 4. The trailing edge of this delay signal will trigger a pulse generator 81 after being differentiated by a capacitor 83 and resistor 85 and coupled via a diode 87.

The signal generated by pulse generator 81 is seen as signal 89 in FIGS. 3 and 4. This signal which is a gating signal is fed to a coincident gate 91 via a diode 93. The trailing edge of signal 50′ will trigger a pulse generator 95 after being differentiated by a capacitor 97 and a resistor 99 and coupled through a diode 101. The output of pulse generator 95 is in the form of a shaper pulse 103 and is fed to coincident gate 91. When, and only when signals 89 and 103 arrive simultaneously at coincident gate 91, an output signal 105 as seen in FIGS. 3 and 4 will activate through a diode 107 a gate of an electronic switch in the form of an SCR 109. A battery 111 is connected to an audible alarm 113. A normally closed switch 115 serves to reset the circuit by opening it momentarily. Thus, the receiver will receive a signal of the prescribed frequency and duration which in turn will permanently activate alarm 113 until it is manually turned off by the reset switch 115. The provision of generators 77 and 95, together with gate 91 will prevent the circuit from being energized by spurious signals.

It will be appreciated that the above described circuit, as well as obvious modifications, will produce an alarm system which will be continuously activated by a splash. However, the transmitter 5 will only operate for an extremely short period of time.

While one embodiment of the invention has been described, it will be understood that it is capable of many further modifications and this application is intended to cover any variations, uses, or adaptions of the invention following in general, the principles of the invention and including such departures from the present disclosure as come within knowledge or customary practice in the art to which the invention pertains, and as may be applied to the essential features hereinbefore set forth and fall within the scope of the invention or the limits of the appended claims.

What I claim is:

1. A condition detection and alarm system comprising:
   a. means for detecting a condition;
   b. means connected to said detecting means for transmitting a signal of short duration in response to the detection of an occurrence of the condition, said transmitting means becoming automatically deenergized after the short transmission, said detecting and transmitting means including:
      1. a transmitting means,
      2. a switch being closed upon the detection of the condition,
      3. means for generating a first pulse for activating a radio frequency transmitter upon closing of said switch,
      4. means responsive to said first pulse generating means for generating a second pulse after said transmitter is activated,
      5. means connected to said second pulse generating means for stopping the flow of current to said transmitting means;
   c. means for receiving said signal and activating an alarm, said alarm continuing to be activated even after de-energisation of said transmitting means.

2. A condition detection and alarm system as defined in claim 1 wherein said detecting and transmitting means is mounted on a float for use in water, and said condition being a sudden wave.

3. A condition detection and alarm system as defined in claim 2 including a pair of electrical contacts mounted on said float and forming a portion of said detecting means, whereby a path formed by water between the contacts will cause said transmitting means to transmit said short signal.

4. A condition detection and alarm system as defined in claim 3 wherein one of said contacts is normally in the water and the other contact is normally out of the water.

5. A condition detection and alarm system as defined in claim 4 including means for varying the distance between said other contact and the water in which said detecting and transmitting means is floating.

6. A condition detection and alarm system as defined in claim 4 including means for preventing rain from establishing a closing path between said other contact and the water.

7. A condition detection and alarm system as defined in claim 1 wherein said stopping means includes energy storage means positioned between said pulse generating means for storing energy to operate said second pulse generating means for a given period of time.

8. A condition detection and alarm system as defined in claim 3 wherein the duration of said signal is about 50 milliseconds.

9. A condition detection and alarm system as defined in claim 1 wherein said receiving means includes:
   a. means for receiving said short signal,
   b. means responsive to said receiving means for generating a pulse resembling said short signal in shape and time in response to receipt of said short signal by said receiving means,
   c. means for feeding a portion of said pulse to a first pulse generator,
   d. means for feeding another portion of said pulse to a second pulse generator,
   e. said two pulse generators being connected to a gate,
   f. means for generating an output signal if the pulses generated by said pulse generators arrive simultaneously at said gate,
   g. said alarm being activated upon the generation of said output signal.

10. A condition detection and alarm system as defined in claim 9 wherein said output signal is connected to the gate of an electronic switch, said alarm being connected between a terminal of a power source and one terminal of said electronic switch, and a normally closed reset switch connected between the other terminal of said electronic switch and another terminal of said power source.

11. A condition detection and alarm system as defined in claim 9 wherein said means for generating a pulse resembling said short signal includes:
   a. a radio frequency amplifier connected to said receiving means,
   b. an oscillator,
   c. said amplifier and oscillator being connected to a detection circuit.

* * * * *